US005404953A

United States Patent [19]

Sangesland

[11] Patent Number: 5,404,953

[45] Date of Patent: Apr. 11, 1995

[54] BLOW-OUT PREVENTION DEVICE FOR SHUTTING OFF AN ANNULUS BETWEEN A DRILL COLUMN AND A WELL WALL WHEN DRILLING FOR OIL OR GAS

[75] Inventor: Sigbjorn Sangesland, Trondheim, Norway

[73] Assignee: Norsk Hydro a.s., Oslo, Norway

[21] Appl. No.: 136,026

[22] Filed: Oct. 14, 1993

[30] Foreign Application Priority Data

Oct. 16, 1992 [NO] Norway ..... 924017

[51] Int. Cl.[6] ..... E21B 23/06

[52] U.S. Cl. ..... 166/363; 166/184; 166/84; 175/24; 175/243

[58] Field of Search ..... 166/335, 363, 121, 184, 166/187, 319; 175/24, 243

[56] References Cited

U.S. PATENT DOCUMENTS 3,322,215 5/1967 Warrington .
3,503,445 3/1970 Cochrum et al. .
3,741,294 6/1973 Morrill ..... 166/363 X
3,853,177 12/1974 Mott ..... 166/187 X
4,367,794 1/1983 Bednar et al. .
4,391,331 7/1983 Shotbolt ..... 166/349 X
4,463,814 8/1984 Horstmeyer et al. ..... 166/212 X
4,558,744 12/1985 Gibb ..... 166/335
4,561,499 12/1985 Berner, Jr. et al. ..... 166/319 X
4,612,993 9/1986 Moore ..... 166/335
4,712,613 12/1987 Nieuwstad .

FOREIGN PATENT DOCUMENTS 0116443 8/1984 European Pat. Off. .
0205297 12/1986 European Pat. Off. .

*Primary Examiner*—William P. Neuder
*Attorney, Agent, or Firm*—Wenderoth, Lind & Ponack

[57] ABSTRACT

A blow-out prevention device shuts off an annulus between a drill column and a well wall by means of an expandable sealing device when an unwanted blow-out of fluid and/or gas takes place from an unstable geological well formation when drilling for oil or gas.

When a blow-out takes place, a compressive-pulse code is activated in the inlet of the drill column and is transmitted through the drilling fluid to a pressure sensor which transmits the compressive-pulse code on to a microprocessor (37) which is preprogrammed with the pressure code. If the pressure codes coincide, an electric motor is activated, which, via a set of gears and a nut-and-bolt device, displaces a valve plate axially towards a valve seat. The drilling fluid then flows out through nozzles and causes a large pressure drop which is used to expand the sealing device so that the annulus is shut.

13 Claims, 2 Drawing Sheets

BLOW-OUT PREVENTION DEVICE FOR SHUTTING OFF AN ANNULUS BETWEEN A DRILL COLUMN AND A WELL WALL WHEN DRILLING FOR OIL OR GAS

BACKGROUND OF THE INVENTION

The present invention relates to a blow-out prevention device for shutting off an annulus between a drill column and a well wall when an unwanted blow-out of fluid and/or gas from an unstable geological well formation occurs when drilling for oil or gas. From U.S. Pat. No. 4,367,794 and EP patent document Nos. 0,116,443 and 0,205,297 devices are known which prevent an unwanted blow-out of fluid and/or gas from an unstable geological well formation when drilling for oil or gas. These known devices for shutting off a fluid and/or gas blow-out have considerable disadvantages. U.S. Pat. No. 4,367,794 concerns an acoustically activated blow-out prevention device which, by means of a motor-activated, movable internal sleeve in a valve body and a flap valve, enables the drilling fluid to circulate out and the annulus between the drill column and the well wall to be shut off. Communication between the sealing device and the annulus is via doors and ducts in the valve body and chokes in the sleeve. The disadvantage is that the seals between the sleeve and the valve body are subject to too much erosive wear on account of the high differential pressure. EP patent document No. 0,116,443 concerns a blow-out prevention device which is activated when a preset differential pressure arises between the annulus pressure and the internal pressure in the drill column. This differential pressure controls a slide valve which is mounted in the valve body. The disadvantage is that the slide valve can easily become stuck and that the seals are subjected to erosive wear. EP patent document No. 0,205,297 concerns a blow-out prevention device in which a solenoid valve controls the pressure to a ball check valve which alters the circulation pattern of the drilling fluid. Activation is by pressure waves being sent through the drilling fluid in the drill column. The disadvantage of this arrangement is that there are at least three valves and that there is, therefore, a certain risk that one or more valves might become stuck or might leak. Shallow, thin gas and/or fluid reservoirs under high pressure represent one of the most serious problems when drilling for gas or oil. Shallow gas is gas which is located in the upper part of a sedimentary geological formation and is usually 200 to 800 meters below the sea bed.

These gas and/or fluid reservoirs are usually 2 to 6 meters thick and often consist of unconsolidated sand with high porosity and permeability. The extent of these reservoirs can be great and the probability of an uncontrolled blow-out can be high, with a correspondingly high risk of well damage. The formation pressure in the upper layer is usually low. To prevent reservoir fluid penetrating into the well, the hydrostatic weight of the drilling fluid column must be higher than the pressure in the reservoir, but not so high as to risk the well wall cracking. If this happens, the drilling fluid located in the drill hole might leak out into the formation and an uncontrolled blow-out might take place as a consequence of the reduced height and thus reduced hydrostatic weight of the drilling fluid column. To increase safety, a blow-out prevention device down in the hole can be used to shut off the annulus between the drill column and the well wall above the unstable, critical reservoir layer. Thereafter, the fluid or gas located above the valve circulates out to the surface and the annulus is filled with fluid which has sufficient specific weight to withstand the reservoir pressure.

SUMMARY OF THE INVENTION

The purpose of the present invention is to improve the operational safety of a blow-out prevention device located in a drill hole when drilling for oil or gas beyond that known from the above-mentioned solutions and which shuts off the annulus between the drill column and the well wall rapidly and efficiently and which, in its design, has a minimum of sealing and valve devices which can be subjected to destructive pressure and erosive wear.

According to the present invention, this is achieved by means of a blow-out prevention device as mentioned in the introduction and which is, furthermore, characterised in that the blow-out prevention device is provided with an internal flow duct through which the drilling fluid flows to a two-way valve arrangement which steers the drilling fluid either to the drill bit or through a number of exit nozzles subject to a large pressure drop which is, furthermore, used to expand a sealing device so that the annulus is shut off.

Moreover, the present invention comprises a compressive-pulse-operated activation system characterised in that a variation in the flow of the drilling fluid through the drill column results in a variation of pressure in the blow-out prevention device which is recorded by a pressure sensor which transmits the pressure level to a microprocessor which is precoded to an activation pressure so that when the pressure in the pressure sensor coincides with the pressure in the microprocessor an electric motor, a set of gears and a nut-and-bolt device are activated to move a valve plate or member axially towards a valve seat.

BRIEF DESCRIPTION OF THE DRAWINGS

The present invention will now be described in more detail by means of examples and with reference to the enclosed drawings, in which.

DETAILED DESCRIPTION OF THE INVENTION

Figure 2:
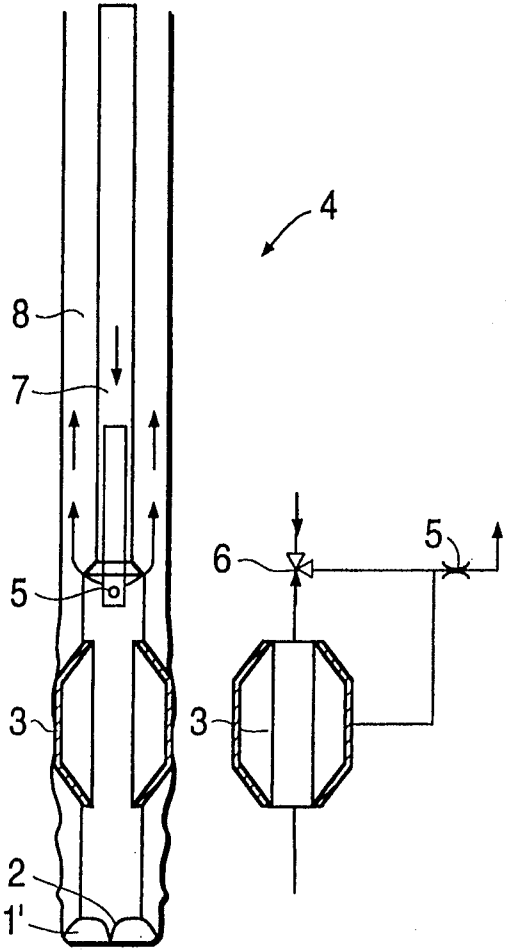
FIG. 2 shows a cross-section of the same device in the same position but in a blow-out situation.
Figure 1:
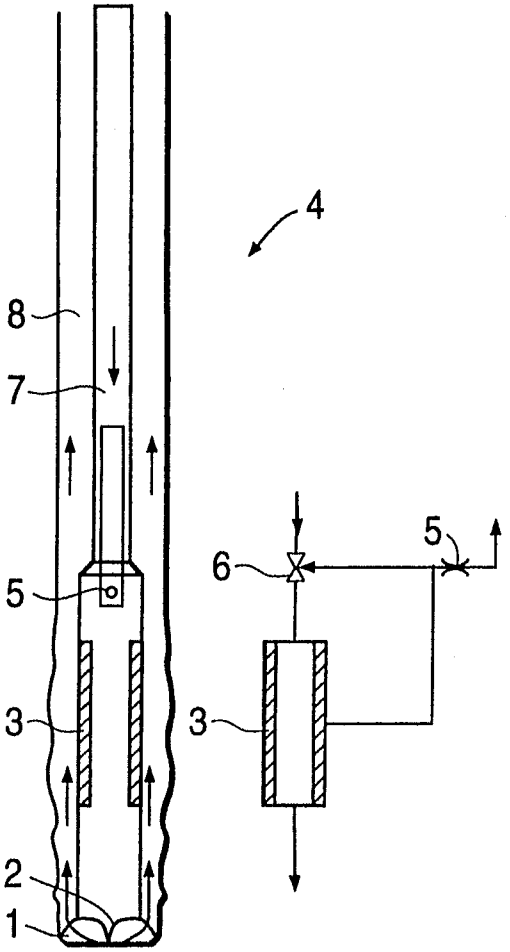
FIG. 1 shows a cross-section of a vertical well hole in which a blow-out prevention device is located in a normal operating situation.

As stated above, FIG. 1 is a cross-section of a well hole in a geological formation in which a drill column 7 is lowered and to the base of which is fastened a blow-out prevention device 4 (FIG. 3) with a drill bit 1 in accordance with the present invention. The situation shown in FIG. 1 is a normal operating situation in which drilling fluid is fed through the drill column 7, through the blow-out prevention device 4, to nozzle 2 and further to a drill bit 1. The drilling fluid is fed to the surface in a annulus 8 between the well wall and the drill column 7 when a valve device 6, as shown in FIG. 1, is open to allow the drilling fluid to flow to the drill bit 1 in an axial direction. FIG. 2 shows a blow-out situation in which the valve 6 is shut in the axial direction but open in the radial direction so that the drilling fluid cannot reach the drill bit. The drilling fluid flows through nozzles 5 under high pressure. The pressure drop which occurs in the nozzles is used to expand a sealing device 3 which is designed to shut off the annulus 8 between the drill column 7 and the well wall.

Figure 3:
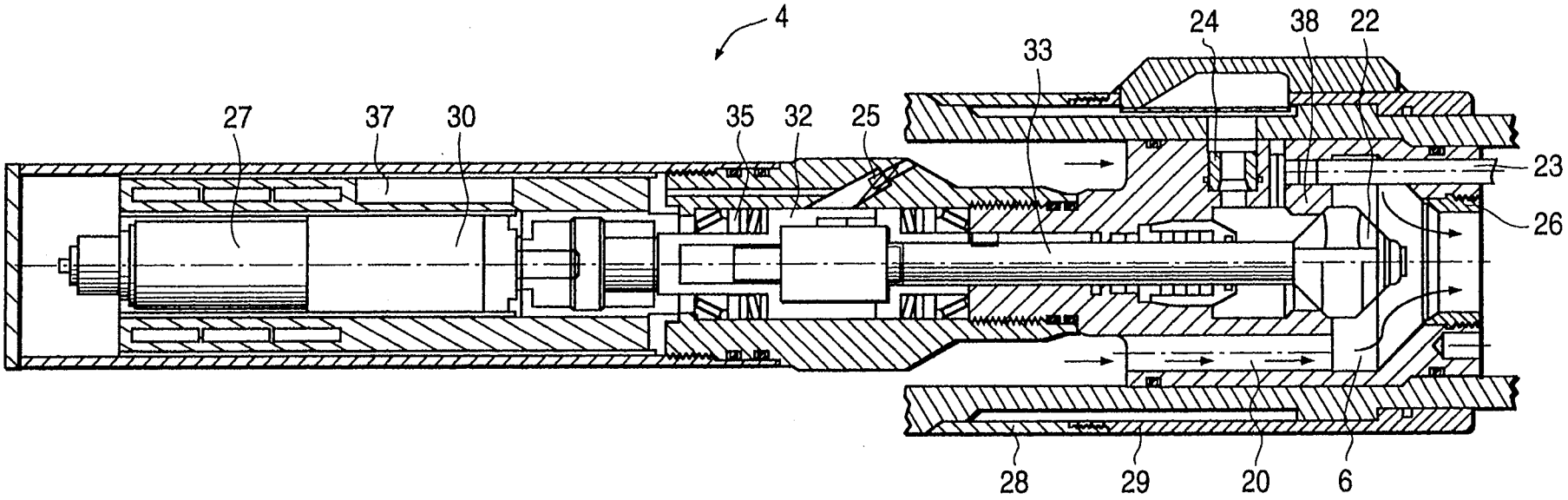
FIG. 3 shows a cross-section of details of a blow-out prevention device.

FIG. 3 shows details of the blow-out prevention device 4. In a normal drilling situation the drilling fluid flows through a flow duct 20 in a body or housing of device 4 to nozzle 2 and the drill bit 1. A valve plate or member 22 is then in the position shown in FIG. 3 against a valve seat 38 and any drilling fluid in the sealing device 3 (see FIG. 2) will be evacuated to the annulus through a duct 23 and exit nozzles 24. Spring 35 urges valve plate 22 against valve seat 38. When a blow-out of gas or fluid takes place from a thin reservoir layer in an unstable geological formation, a compressive-pulse code is activated in the drill column inlet or inner end and is transmitted through the drilling fluid to a pressure sensor 25 in the blow-out prevention device 4. The compressive-pulse code is transmitted on to a microprocessor 37 which is preprogrammed to be able to recognize the activation code. If the codes coincide, an electric motor 27 is activated which drives a set of gears 30 and a nut-and-bolt device 32, 33 which displaces the valve plate 22 in an axial direction until it meets another valve seat 26 in the valve body. Motor 27 may have a control unit that shuts off motor 27 at a preset sealing pressure between valve plate 22 and valve seat 26. The drilling fluid then flows in another direction and through the exit nozzles 24 with a considerable pressure drop which is used to expand the sealing device 3. To prevent the erosion of the well wall, the blow-out prevention device 4 is provided with a circular, externally located sleeve 29 which covers the exit nozzles 24, and a flexible sleeve 28 in connection with sleeve 29 to prevent drilling particles from penetrating into the exit nozzles 24 during normal drilling.

It is claimed:

1. In a blow-out prevention device to be included in a drill column for shutting off an annulus between the drill column and a well wall when an unwanted blow-out occurs from an unstable geological well formation when drilling for oil or gas, wherein drill fluid is flowed through the drill column to a drill bit thereof and then through the annulus, the improvement wherein said device comprises:

a body having therein an internal flow duct through which incoming drill flows to the drill bit;

a sealing device positioned externally of said body;

at least one nozzle extending through said body from said internal flow duct to said external sealing device; and a two way valve member in said body and mounted on a valve rod for movement thereby between a normal position, opening said internal flow duct to allow incoming drill fluid to flow to the dill bit and blocking incoming drill fluid from said nozzle leading to said sealing device, and a blow-out preventing position, blocking incoming drill fluid in said internal flow duct from flowing therethrough to the drill bit and opening said nozzle to incoming drill fluid, whereby the drill fluid passes through said nozzle and is pressurized to expand said sealing device to shut off the annulus.

2. The improvement claimed in claim 1, wherein said at least one nozzle comprises plural nozzles extending radially outwardly from said internal flow duct to said sealing device.

3. The improvement claimed in claim 1, further comprising first and second valve seats in said body, said valve member abutting said first valve seat in said normal position and abutting said second valve seat in said blow-out preventing position.

4. The improvement claimed in claim 3, further comprising a spring mounted to urge said valve member into sealing contact with said first valve seat.

5. The improvement claimed in claim 3, wherein said valve rod is movable longitudinally between said positions of said valve member by a nut and bolt arrangement.

6. The improvement claimed in claim 5, further comprising a gear set positioned to actuate said nut and bolt arrangement.

7. The improvement claimed in claim 6, further comprising an electric motor mounted to drive said gear set.

8. The improvement claimed in claim 7, wherein said electric motor is provided with a control unit operable to cut off power to said electric motor at a preset sealing pressure between said valve member and said second valve seat.

9. The improvement claimed in claim 1, further comprising a control system mounted on said body and operable to move said valve member from said normal position to said blow-out preventing position upon the occurrence of a blow-out.

10. The improvement claimed in claim 9, wherein said control system comprises an electric motor operably coupled to said valve rod to initiate movement thereof, a pressure pulse sensor operable to detect a pressure pulse within the drill fluid, and a microprocessor coupled to said pressure pulse sensor to receive therefrom signals representative of pressure pulses detected thereby and preprogrammed to activate said electric motor to move said valve rod when a signal received from said pressure pulse sensor equals a preset signal representative of a blow-out condition at an inner end of the drill column.

11. The improvement claimed in claim 1, further comprising a pressure absorbing sleeve positioned externally of said body.

12. The improvement claimed in claim 11, further comprising a flexible sleeve fastened to said pressure absorbing sleeve.

13. A compressive pressure pulse operated control system to be employed as part of a blow-out prevention device to initiate movement of a two way valve member thereof to a blow-out preventing position to interrupt flow of drill fluid through a drill column and to shut off an annulus between the drill column and a well wall, said control system comprising:

an electric motor to be operably coupled to the valve member to initiate movement thereof;

a pressure pulse sensor operable to detect a pressure pulse within drill fluid; and a microprocessor coupled to said pressure pulse sensor to receive therefrom signals representative of pressure pulses detected thereby and preprogrammed to activate said electric motor to move the valve member when a signal received from said pressure pulse sensor equals a preset signal representative of a blow-out condition at an inner end of the drill column.

* * * * *